United States Patent [19]

Litchfield

[11] 4,186,979

[45] Feb. 5, 1980

[54] DRAWERS

[75] Inventor: Leon G. Litchfield, both of Derby, England

[73] Assignee: L. B. (Plastics) Limited, Derby, England

[21] Appl. No.: 923,795

[22] Filed: Jul. 12, 1978

[30] Foreign Application Priority Data

Jul. 23, 1977 [GB] United Kingdom ..... 31040/77

[51] Int. Cl.[2] ..... A47B 88/16

[52] U.S. Cl. ..... 312/333; 312/341 R; 312/348

[58] Field of Search ..... 312/330, 333, 341-348, 312/350; 308/3.6, 3.8

[56] References Cited

U.S. PATENT DOCUMENTS

| | | | |
|---|---|---|---|
| 3,456,996 | 7/1969 | Schor | 312/347 |
| 3,726,579 | 4/1973 | Ullman, Jr. | 312/330 R |
| 4,065,196 | 12/1977 | Stein | 312/348 |
| 4,099,815 | 7/1978 | Cox et al. | 312/330 R |
| 4,121,878 | 10/1978 | Lokken | 312/350 |

*Primary Examiner*—Casmir A. Nunberg

*Attorney, Agent, or Firm*—Marshall & Yeasting

[57] ABSTRACT

A drawer having longitudinal tracks formed in the opposite side walls thereof and a pair of guide members mounted at the rear corners of the drawer and movable between retracted positions in which the guide members are clear of the rear ends of the associated tracks and operative positions in which the guide members extend across the ends of the respective tracks, the guide members being adapted to engage with respective drawer runners mounted in a supporting structure in which the drawer is supported in use to support and guide the rear end of the drawer on the runners.

18 Claims, 3 Drawing Figures

DRAWERS

The invention relates to drawers.

Most conventional drawers are supported either on fixed runners engaging in recesses in the drawer sides and having bearing surfaces on which the drawer is supported for sliding movement between open and closed positions, or on roller runner assemblies comprising co-operating components adapted for attachment to the drawer sides and to the cabinet or like supporting structure in which the drawer is mounted in use, the components carrying rollers which roll over co-operating bearing surfaces on the components during opening and closing movement of the drawer.

Drawers mounted on fixed runners are of simple construction but suffer from the disadvantage that a relatively large bearing surface is provided and this generates friction forces which render such constructions unsatisfactory where the drawers require to support heavy loads. Conventional roller runner arrangements reduce the area of contact and eliminate direct sliding friction so that they are suitable for supporting heavier loads. They also produce a smoother action but generally suffer from the disadvantage that they are relatively complex and hence expensive.

It is an object of the present invention to provide a drawer construction having most of the advantages of roller mounting but which is relatively simple and inexpensive.

The invention provides a drawer having longitudinal tracks formed in the opposite side walls thereof and a pair of guide members mounted at the rear corners of the drawer and moveable between retracted positions in which the guide members are clear of the rear ends of the associated tracks and operative positions in which the guide members extend across the ends of the respective tracks, the guide members being adapted to engage with respective drawer runners mounted in a supporting structure in which the drawer is supported in use to support and guide the rear end of the drawer on the runners.

The drawer is intended to be used in association with drawer runners having bearing members mounted at the forward ends thereof adapted to engage within said tracks in the drawer-sides, said bearing members and said guide members serving to support and guide the drawer during opening and closing movement thereof.

Preferably each of said tracks is provided with longitudinal lips projecting across the mouth of the track towards one another so as to form a relatively narrow entrance thereto, the bearing members on the associated runners having a height greater than the height of said entrance whereby said lips prevent lateral withdrawal of the bearing members from the associated tracks. The drawer is engaged with the runners by inserting the bearing members into the associated tracks from the rear ends thereof with the guide members in their retracted positions, movement of the guide members to their operative positions preventing removal of the bearing members from the tracks. The bearing members may comprise one or more rollers or a slide arrangement.

Preferably also the drawer runners are of angle section having a mounting flange adapted to be supported in a cabinet or like structure in which the drawer is to be mounted in use, and a drawer-engaging flange projecting at right angles to the mounting flange and adapted to extend into the track in the associated side of the drawer through the narrow entrance thereof, one of said flanges rotatably supporting said bearing member with its central axis disposed in the plane of the drawer-engaging flange.

Preferably also said guide members are provided with outwardly opening slots adapted to receive the drawer-engaging flanges of the associated runners and to ride along same during opening and closing movements of the drawer.

Advantageously the rear wall of the drawer is provided with a longitudinal track similar to those formed in the side walls, said guide members being slidably located in the track in the rear wall and having actuating means projecting through the rear wall to the inside surface thereof to enable the guide members to be moved between their retracted and operative positions by manual operation from within the drawer.

An embodiment of the invention will now be described, by way of example only, with reference to the accompanying drawings, in which.

Figure 3:
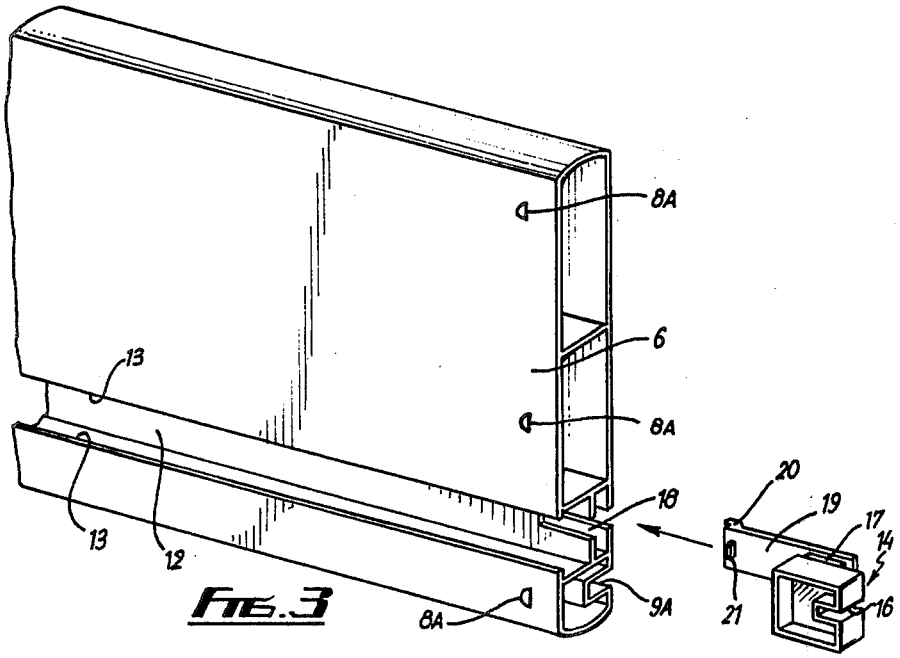
FIG. 3 is an exploded perspective view showing part of the drawer back and one of the guide members detached therefrom.

Referring to the drawings, the drawer is constructed in a manner similar to that disclosed in our co-pending application Ser. No. 816,039 and comprises extruded side wall panels 5 and an extruded back wall panel 6 interconnected by corner pieces 7 having spigot members (not shown) projecting therefrom in two directions at right angles and provided with detents 8 which engage in holes 8A (FIG. 3) adjacent the ends of the associated wall panels to connect them to one another at right angles. The wall panels are provided with inwardly directed slots 9A (FIG. 3) adapted to receive and support the edges of a drawer base 9, and a drawer front 10 is connected to the sides by means of front connectors 11 which are screwed to the rear face of the drawer front and have spigots projecting therefrom which engage in the open ends of the extruded side wall panels 6 and are provided with detents 8 which engage in holes in the side wall panels to secure the drawer front thereto. The drawer front is also provided with a slot to receive and support the forward edge of the drawer base 9.

Figure 1:
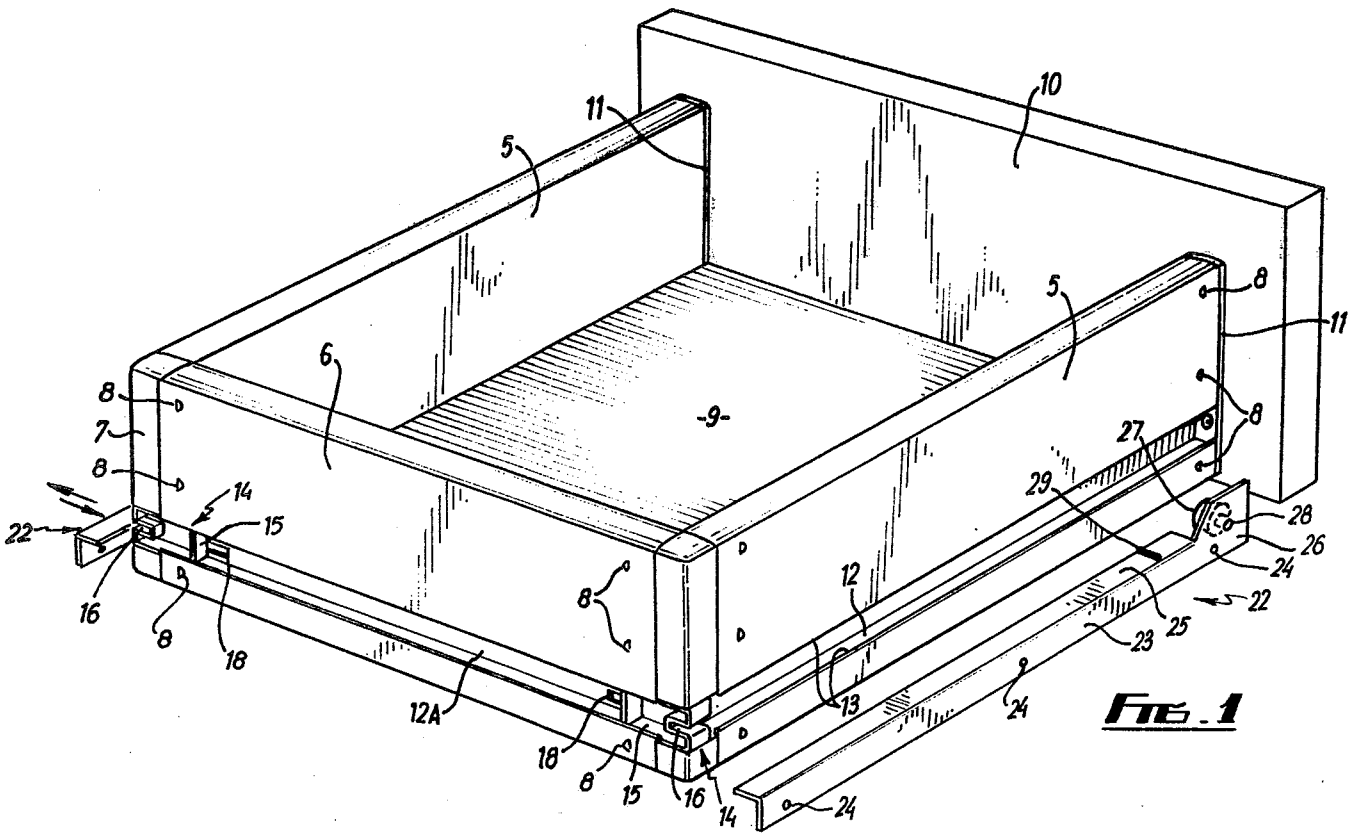
FIG. 1 is a perspective view of a drawer and runner assembly according to the invention showing the rear guide members in their operative positions.

A longitudinal track or channel 12 is provided in the outer face of each of the side wall panels 5 and has upper and lower lips 13 which project across the mouth of the track 12 towards one another so as to define a relatively narrow entrance to the track. A similar track or channel 12A is formed in the back wall panel 6, and rear guide members 14 are slidably received in the opposite ends of the channel 12A. Each guide member includes a body portion 15 which is retained and guided in the channel 12A by the lips 13 and incorporates an outwardly directed slot 16 adapted to engage with an associated drawer runner. The body portion 15 is connected by means of a slide block 17 received in a slot 18 formed in the rear wall of the channel 12A to actuating means in the form of a latch member 19, the arrangement being such that the latch member 19 is disposed on the inside of the drawer. The latch member includes a finger piece 20 enabling manipulation of the latch member by the user, and a locking projection 21 which engages with the inner end of the slot 18 to lock the guide member 14 in its operative position shown in FIG. 1. In order to move the guide member to its inoperative position the finger piece is moved towards the front of the drawer to release the locking projection 21 from engagement with the slot 18 and the latch member 19 may then be pushed towards the centre of the back wall of the drawer to move the guide member 14 to the retracted position shown in FIG. 2.

The drawer is mounted in a cabinet or like supporting structure in which it is to be located in use by means of a pair of runners 22 each of which is of angle section and comprises a mounting flange 23 provided with holes 24 at intervals therealong enabling the runner to be screwed or otherwise secured in a suitable position in the drawer cabinet. The runner also includes a drawer engaging flange 25 projecting at right angles from the mounting flange 23 and adapted to extend into the track 12 in the associated side of the drawer through the narrow entrance thereto. The mounting flange 23 extends beyond the drawer-engaging flange 25 at its forward end and the extension 26 supports a bearing member in the form of a roller 27 rotatably mounted on a pin 28. The axis of the pin 28 lies in the plane of the drawer-engaging flange 25 and the latter is provided with a stop member 29 comprising a projection on the upper surface of the flange adjacent its forward end. The diameter of the roller 27 is such that when engaged in the associated track 12 in the side of the drawer the roller may move along the track but is retained against lateral withdrawal from the track by the projecting lips 13.

Figure 2:
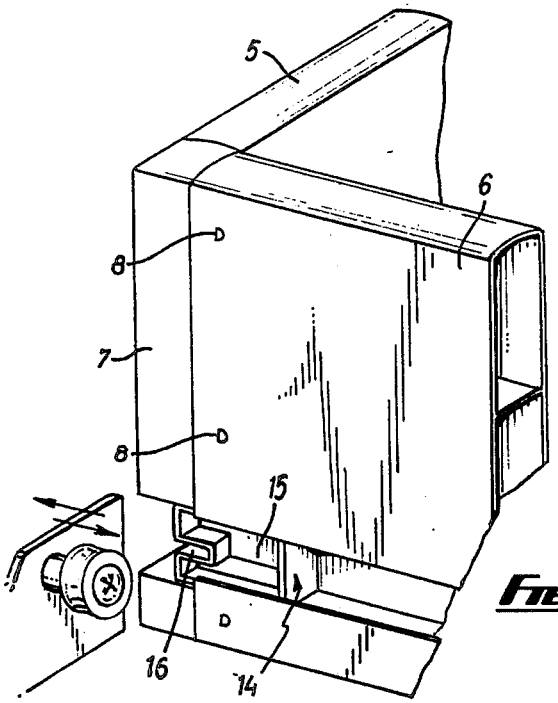
FIG. 2 is a fragmentary perspective view of one corner of the drawer showing the associated guide member in its retracted position.

In use of the drawer assembly the runners 22 are mounted in suitable positions in the cabinet or other supporting structure and the latch members 19 are moved inwardly so as to move the guide members 14 to their retracted positions in which they are clear of the rear ends of the tracks 12 in the sides of the drawer. The drawer may then be engaged in the cabinet as shown in FIG. 2 the rollers 27 entering the tracks 12 from the rear and being retained therein by the lips 13. Once the rollers have been introduced into the tracks the latch members 19 are moved outwardly thereby moving the guide members 14 into their operative positions in which they project across the rear ends of the associated tracks 12 and prevent disengagement of the drawer from the rollers. The slots 16 in the guide members 14 engage the drawer-engaging flanges 25 of the associated runners and slidably guide and support the rear end of the drawer on the runners. The forward end of the drawer is supported on the rollers 27. When the latches 19 are moved to their outer positions the locking projections 21 drop into engagement with the inner ends of the slots 18 in the rear wall and retain the guide members against inward movement. The drawer may then be moved between open and closed positions at will with the rear end supported on the flanges 23 of the associated runners and the drawer being supported forwardly of the guide members 14 by the rollers 27.

Although the rear guide members 14 would act as drawer stops preventing complete withdrawal of the drawer from the cabinet, it is desirable in practice to limit the extent to which the drawer can be moved out of the cabinet in order to reduce the strain on the structure in the open position, especially when the drawer is heavily loaded. This is effected by means of the stop members 29 on the runners which abut the associated guide members 14 when the drawer has been moved out of the cabinet to the desired maximum extent and prevent further withdrawal. If it is desired to remove the drawer entirely from the cabinet it is moved to its open position, the latch members 19 are moved inwardly, thereby moving the guide members 14 to their retracted positions clear of the rear ends of the tracks 12 and the drawer may then be pulled clear of the cabinet since the retracted guide members 14 can pass the rollers 27.

It should be noted that the runners 22 are so constructed that they may be mounted in the supporting structure with the drawer-engaging flange 25 either above (as shown) or below the mounting flange 23, the latter arrangement enabling heavier loads to be supported. This is possible because the pin 28 on which the roller 27 is mounted lies in the plane of the drawer-engaging flange 25.

The arrangement described provides a drawer construction in which a roller mounting arrangement is incorporated providing for smooth opening and closing movement of the drawer and enabling relatively heavy loads to be supported but at the same time being of relatively simple and inexpensive construction. A 'tracking' or guiding effect is also achieved by virtue of the rollers 27 being trapped within the tracks in the drawer sides. This reduces side play and provides a smoother action. It should also be noted that each runner comprises only a single member which, by virtue of retention of the associated roller within the track in the drawer itself eliminates the need for an additional complimentary runner member secured to the drawer as in the case of conventional roller runner constructions.

Various modifications may be made without departing from the invention. For example while in the arrangement described the drawer is constructed from extruded panels interconnected by corner pieces, the invention could be applied to drawers of more conventional construction. The rear guide members need not be accommodated in channels in the rear wall of the drawer but could be attached to the outer or inner surface thereof and arranged in the latter case to project through suitable openings in the rear ends of the side walls. The runners could also be differently constructed and the roller may be replaced by a plurality of rollers or by a slide arrangement or other front bearing member.

We claim:

1. A drawer having a front wall, a rear wall and opposed side walls, longitudinal tracks formed in said side walls, and a pair of guide members mounted at the rear corners of the drawer and moveable between retracted positions in which the guide members are clear of the rear ends of the associated tracks and operative positions in which the guide members extend across the ends of the respective tracks, the guide members being adapted to engage with respective drawer runners mounted in a supporting structure in which the drawer is mounted in use to support and guide the rear end of the drawer on the runners, and each of said guide members including an actuating member to facilitate sliding movement of said guide member between said retracted and operative positions.

2. A drawer according to claim 1 wherein the rear wall of the drawer is provided with a longitudinal track similar to those formed in the side walls, said guide members being slidably located in the track in the rear wall.

3. A drawer according to claim 1 or 2 including stop means operable to limit the extent of retracting movement of each guide member.

4. A drawer according to claim 3 wherein each of said guide members is slidably engaged with a slot in the inner vertical wall of said track in the rear wall of the drawer, the inner end of said slot serving as said stop means.

5. A drawer according to claim 2 wherein said actuating members project through said inner vertical wall to the interior of the drawer to enable the guide members to be moved between their retracted and operative positions by manual operation from within the drawer.

6. A drawer according to claim 5 wherein each of said actuating members is provided with a finger piece to facilitate movement of the associated guide member between said retracted and operative positions.

7. A drawer according to claim 1, 2 or 5 including locking means for locking said guide members in their operative positions.

8. A drawer according to claim 1, 2 or 5 wherein each of said tracks is provided with longitudinal lips projecting across the mouth of the track towards one another so as to form a relatively narrow entrance thereto.

9. A drawer according to claim 1, 2 or 5 in association with a pair of drawer runners having bearing members mounted at the forward ends thereof adapted to engage within said tracks in the drawer-sides, said bearing members and said guide members serving to support and guide the drawer during opening and closing movement thereof.

10. A drawer according to claim 9 wherein the bearing members comprise rollers.

11. A drawer according to claim 9 wherein each of said drawer runners is of angle section having a mounting flange adapted to be supported in a cabinet or like structure in which the drawer is to be mounted in use, and a drawer-engaging flange projecting at right angles to the mounting flange and adapted to extend into the track in the associated side of the drawer, one of said flanges rotatably supporting said bearing member.

12. A drawer according to claim 11 wherein the central axis of said bearing member is disposed in the plane of said drawer-engaging flange.

13. A drawer according to claim 12 wherein said guide members are provided with outwardly opening slots adapted to receive the drawer-engaging flanges of the associated runners and to ride along same during opening and closing movements of the drawer.

14. A drawer according to claim 13 wherein said drawer runners may be mounted in the supporting structure with said drawer-engaging flange either above or below said mounting flange.

15. A drawer according to claim 11 including stop means on one of said flanges for engagement with the associated guide member to limit the extent to which the drawer can be withdrawn from its supporting structure during normal opening and closing movements thereof.

16. A drawer according to claim 15 wherein said stop means comprises a raised portion of said drawer-engaging flange adjacent the forward end thereof.

17. A drawer according to claim 7 wherein each of said guide members is slidably engaged with a slot in the inner vertical wall of said track in the rear wall of the drawer, each of said actuating members being provided with a finger piece to facilitate movement of the associated guide member between said retracted and operative positions, and a locking projection being provided on said finger and being adapted to engage with the inner end of said slot to lock the associated guide member in its operative position.

18. A drawer according to claim 9 wherein each of said tracks is provided with longitudinal lips projecting across the mouth of the track towards one another so as to form a relatively narrow entrance thereto, said bearing members having a height greater than the height of said entrance whereby said lips prevent lateral withdrawal of the bearing members.

* * * * *